US006357642B1

(12) United States Patent
Marchessault et al.

(10) Patent No.: US 6,357,642 B1
(45) Date of Patent: Mar. 19, 2002

(54) CLIP FOR SECURING A GOLF BALL MARKER TO A HAT

(76) Inventors: Timothy Marchessault; Robin Lee Marchessault, both of 1306 SE. 46th La., #2, Cape Coral, FL (US) 33904

( * ) Notice: Subject to any disclaimer, the term of this patent is extended or adjusted under 35 U.S.C. 154(b) by 0 days.

(21) Appl. No.: 09/648,317

(22) Filed: Aug. 25, 2000

(51) Int. Cl.[7] ..... A45F 5/00

(52) U.S. Cl. ..... 224/269; 2/209.13; 224/194; 224/249; 224/666; 224/918; 473/406

(58) Field of Search ..... 224/269, 249, 224/666, 667, 918, 194; 2/209.13; 24/3

(56) References Cited

U.S. PATENT DOCUMENTS

| | | | | |
|---|---|---|---|---|
| 459,942 | A | | 9/1891 | Brown |
| 2,178,872 | A | | 11/1939 | Engstrom |
| 2,597,601 | A | | 4/1952 | Sherman |
| 2,693,645 | A | | 11/1954 | Clark |
| 2,979,335 | A | | 4/1961 | Pruitt |
| 3,136,547 | A | | 6/1964 | Schaper |
| 3,139,690 | A | | 7/1964 | Hait |
| 3,208,123 | A | | 9/1965 | Koos |
| 3,233,802 | A | | 2/1966 | Ludwick |
| 3,321,119 | A | | 5/1967 | D'Andrea |
| 3,415,518 | A | | 12/1968 | Root |
| 3,546,709 | A | | 12/1970 | Cross |
| 4,130,950 | A | | 12/1978 | Bazzle et al. |
| 4,489,444 | A | | 12/1984 | Graham |
| 4,627,621 | A | | 12/1986 | Tate |
| 4,826,059 | A | | 5/1989 | Bosch et al. |
| 4,885,195 | A | | 12/1989 | Change, III |
| 5,135,220 | A | | 8/1992 | Baldoni |
| 5,295,683 | A | | 3/1994 | Tate |
| 5,305,999 | A | | 4/1994 | Tate |
| 5,364,094 | A | | 11/1994 | Mustion |
| 5,433,436 | A | * | 7/1995 | Hoyt et al. ..... 224/918 X |
| D362,821 | S | | 10/1995 | Marchessault |
| 5,460,346 | A | * | 10/1995 | Hirsch ..... 224/194 X |
| 5,593,073 | A | | 1/1997 | Finnegan |
| 5,715,539 | A | | 2/1998 | Benecki et al. |
| 5,733,208 | A | | 3/1998 | Fazekas |
| 5,829,103 | A | * | 11/1998 | Allen ..... 224/269 X |
| 5,898,943 | A | | 5/1999 | Kim |
| 5,898,946 | A | | 5/1999 | Keating et al. |
| 5,930,839 | A | | 8/1999 | Schupp |
| 5,996,116 | A | | 12/1999 | Tate |
| 6,004,229 | A | | 12/1999 | Fazekas |
| 6,052,828 | A | | 4/2000 | Widdemer |
| 6,209,766 | B1 | * | 4/2001 | Kwon ..... 224/269 |

FOREIGN PATENT DOCUMENTS

| | | |
|---|---|---|
| CA | 2126169 | 12/1994 |
| CA | 2219612 | 10/1997 |

OTHER PUBLICATIONS

Make Your Make Golf Accessories advertising flyer.

* cited by examiner

*Primary Examiner*—Stephen K. Cronin
*Assistant Examiner*—Maerena W. Brevard
(74) *Attorney, Agent, or Firm*—Laura G. Barrow

(57) ABSTRACT

A hat clip comprising two hingably secured jaws, a magnet, and a golf ball marker is described. The hat clip may be secured to the inner hat band of a golf cap, hat, or visor and is designed such that a golf ball marker may be magnetically maintained on the outside of the hat while the jaws of the hat clip are hidden from view.

8 Claims, 4 Drawing Sheets

CLIP FOR SECURING A GOLF BALL MARKER TO A HAT

BACKGROUND AND SUMMARY OF THE INVENTION

While playing a round of golf, a golfer will typically remove his/her golf ball from the putting green while the opposing golfer putts. Some type of marker, generally. small and flat, is placed on the spot where the golf ball was removed to indicate where the golfer should replace his/her ball prior to putting. Golf ball markers are typically carried in the golfer's pockets, stored in the golf club bag, or kept on the golf cart. Some golf ball markers are formed of a magnetic material and attached to the brim of the golfer's hat or visor by means of a magnetic hat clip. The present invention is an improved hat clip and method for attaching a golf ball marker to the golfer's hat.

DETAILED DESCRIPTION OF THE PREFERRED EMBODIMENTS

Figure 1:
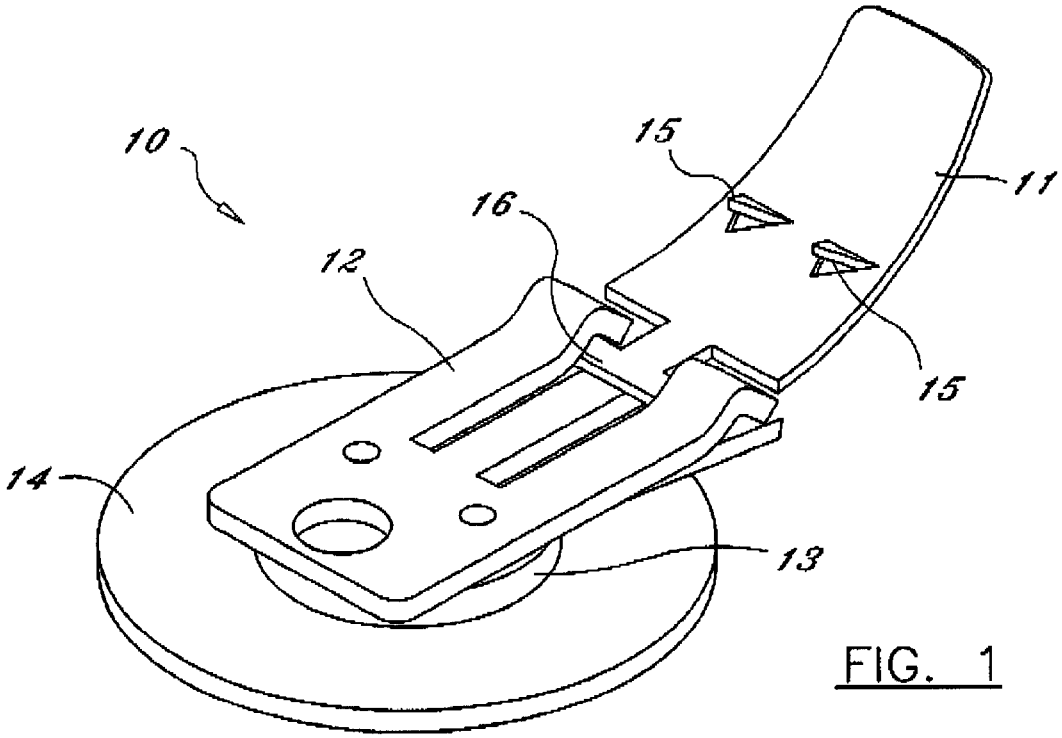
FIG. 1 is a perspective view of the inventive hat clip in an"opened" position.
Figure 5:
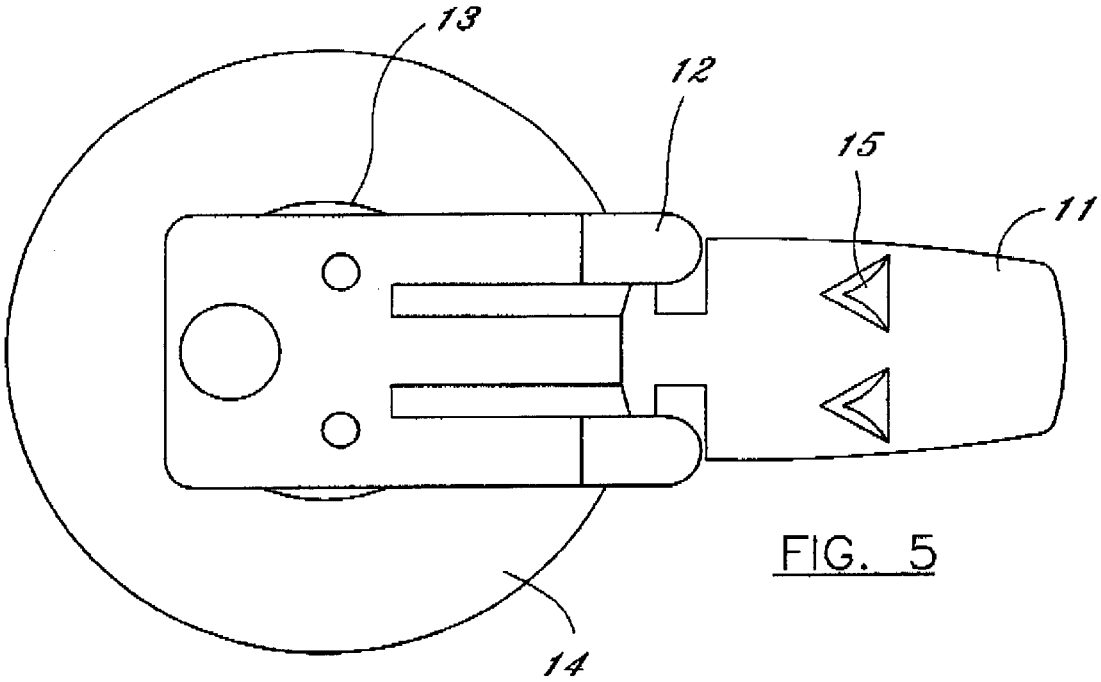
FIG. 5 is a front view of the hat clip in the opened position (with golf ball marker attached).
Figure 6:
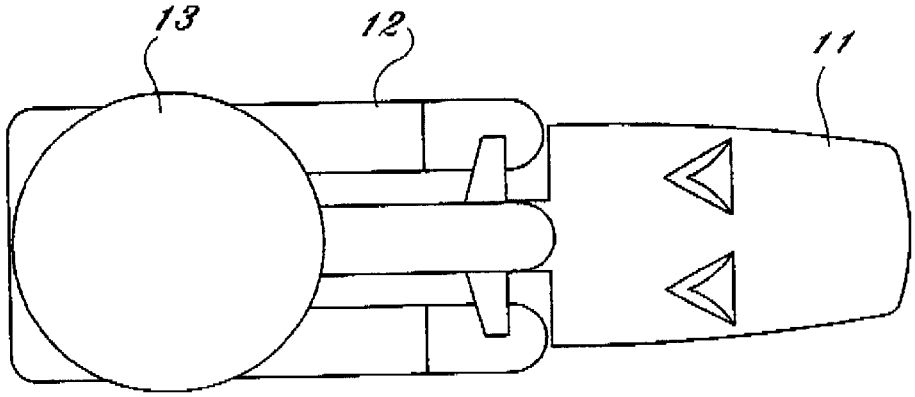
FIG. 6 is a back view of the hat clip in the opened position (without the golf marker).

Referring now to the figures, the present invention, in certain aspects, is directed to a hat clip comprising a magnet to which a golf ball marker may be attached after the clip is secured to a hat. Specifically, the hat clip (10) comprises two jaws (11,12) that are hingably secured to one another a one end of each jaw, as best shown in FIGS. 1 and 5–6. While the figures illustrate one type of design for the jaws and hinged connection, it will be appreciated by the skilled artisan that a variety of clip designs, including hinge assemblies, may be employed.

In one embodiment of the invention, one jaw (12) has secured to its outer face **(12*a*) a magnet (13). Alternatively, the jaw (12)** may be magnetized. A preferred magnet type is a neodymium magnet. An exemplary neodymium magnet that performs well has dimensions of 0.375 in. diameter (d)×0.100 in. thickness (t)±0.006(d)×0.005(t) and is nickel-plated 27 MGO. This type of strong magnet is particularly desirable since the magnet must be strong enough to firmly hold a magnetically attractive ball marker through a layer of heavy fabric (as discussed further below). Other magnets having similar magnetic strength may be employed, as well.

Figure 2:
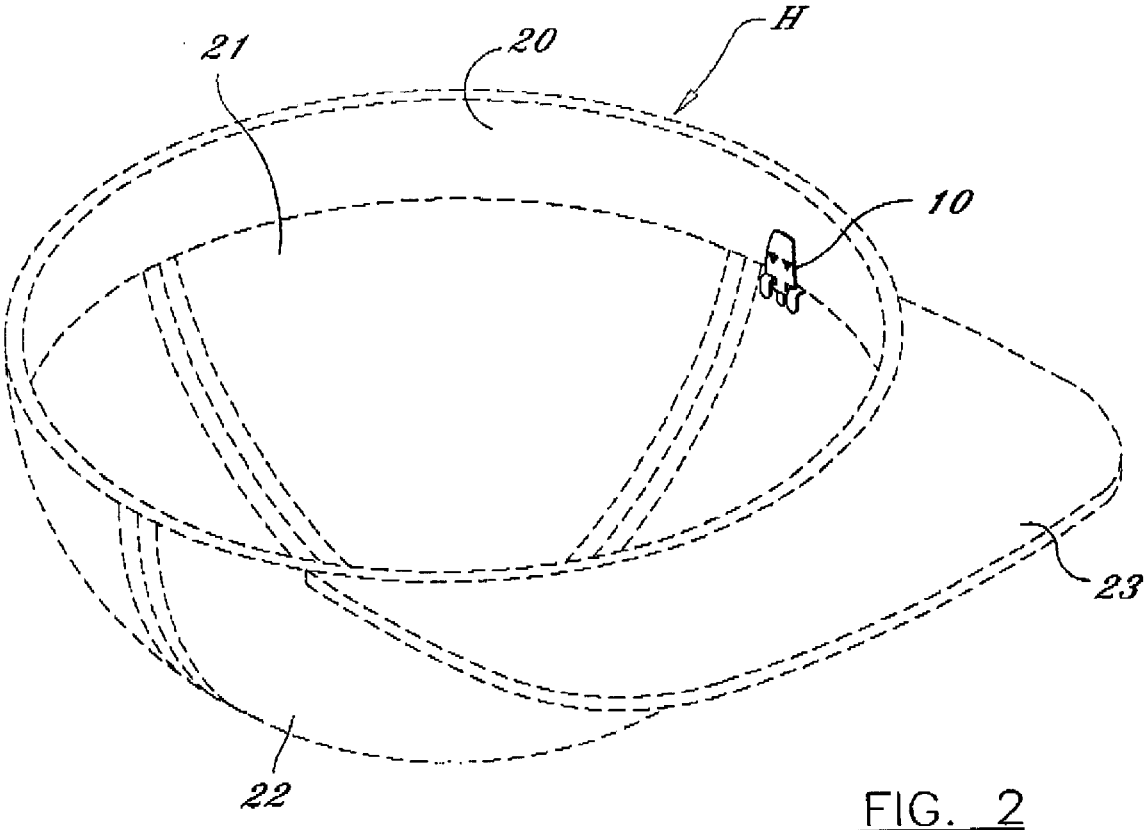
FIG. 2 is a bottom view of a hat with the hat clip attached thereto.
Figure 3:
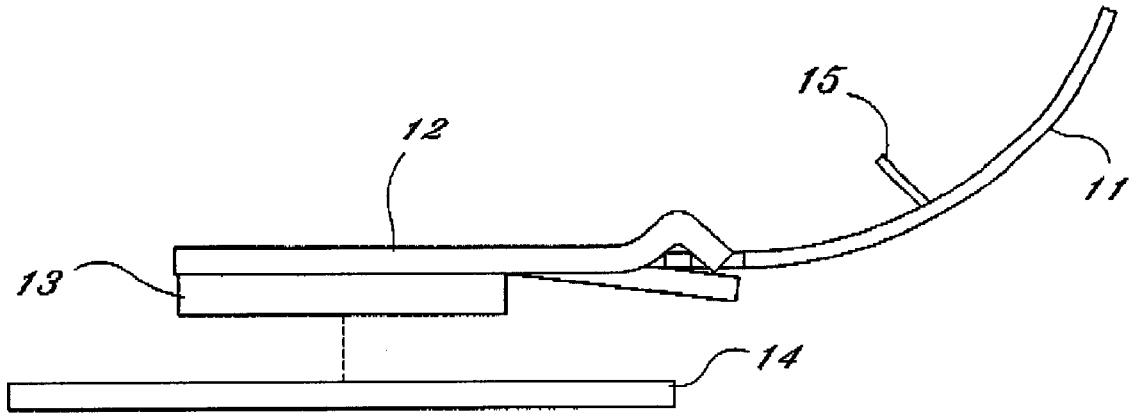
FIG. 3 is a side view of the hat clip in the"opened" position.
Figure 4:
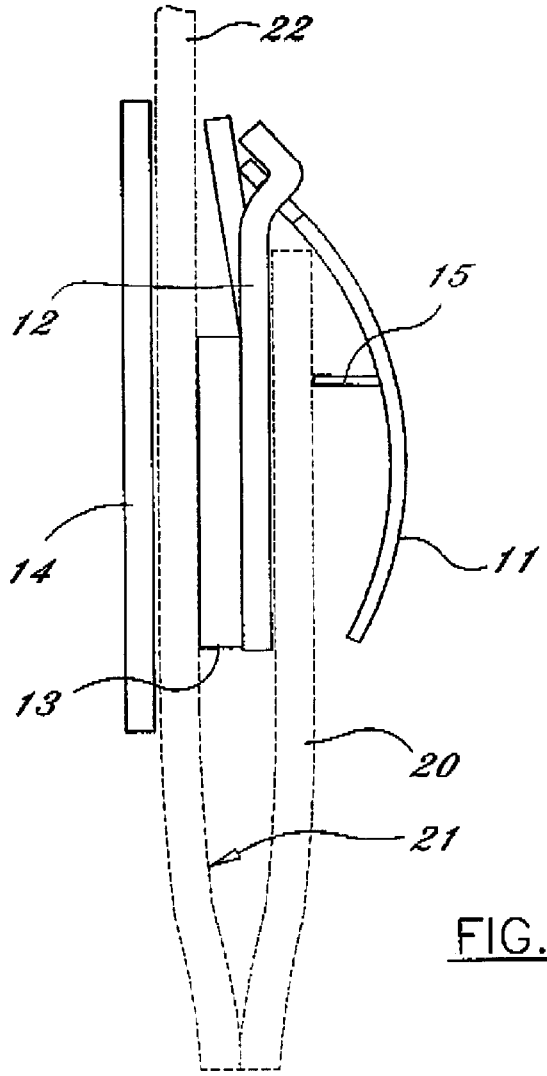
FIG. 4 is a sectional view a hat and inner hat band showing the hat clip attached thereto.
Figure 7:
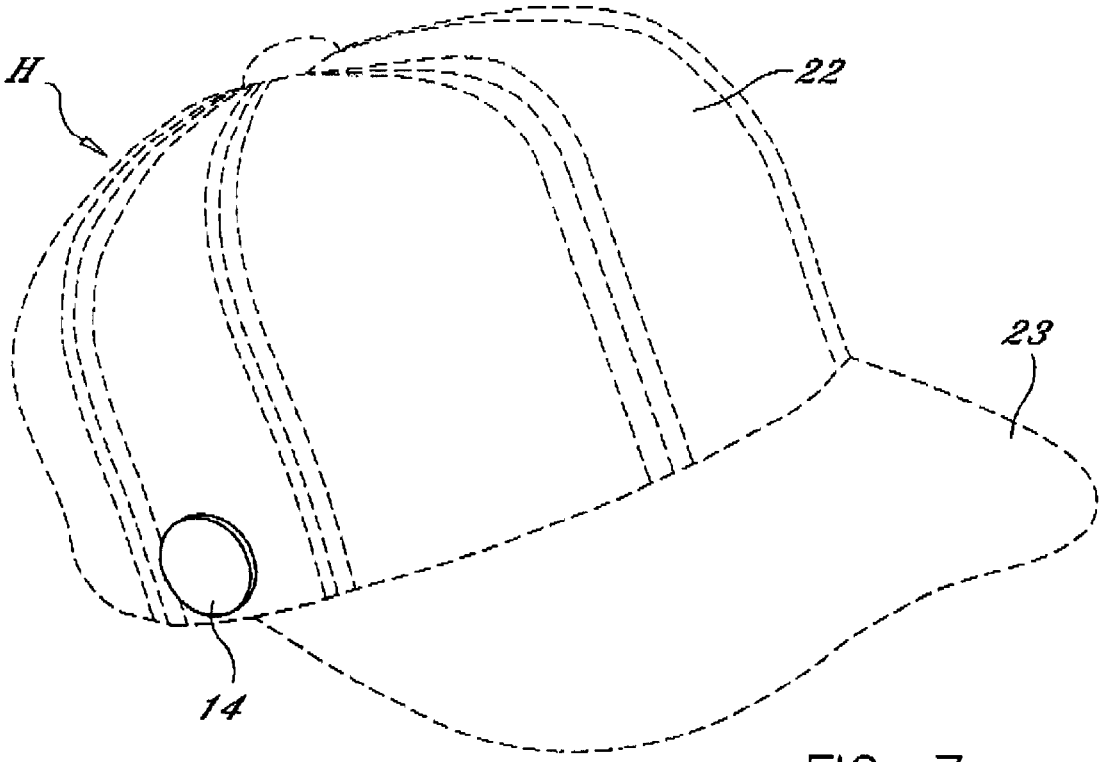
FIG. 7 is a perspective view of a cap with the hat clip attached thereto.
Figure 8:
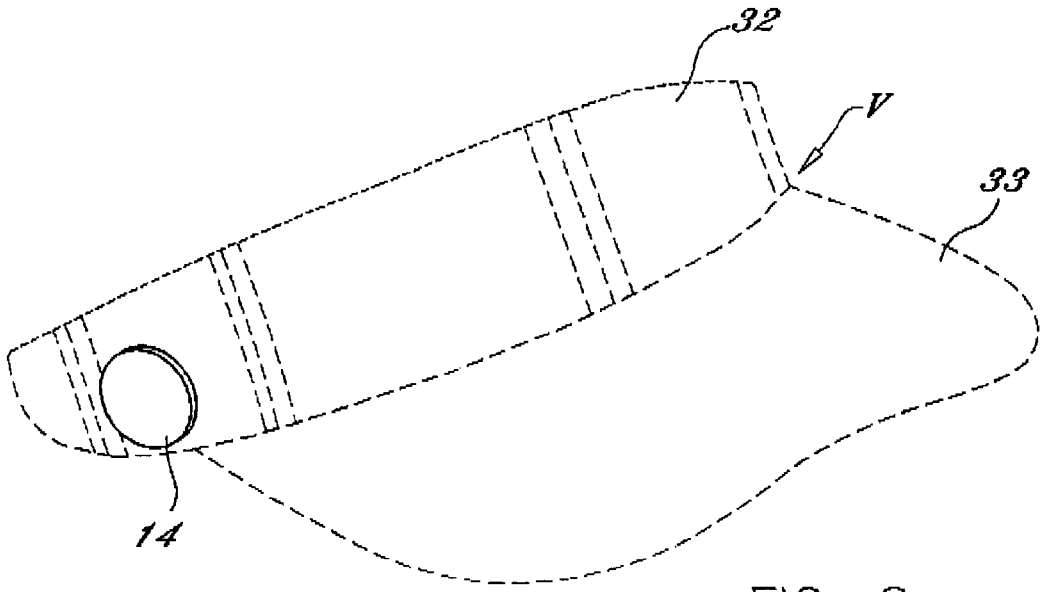
FIG. 8 is a perspective view of a visor with the hat clip attached thereto.

The clip (10) may be secured to a variety of hats, including a golf cap, as illustrated herein. As used herein, the term"hat" means any type of headgear, including, but not limited to, caps, hats, and visors as described and/or illustrated herein. For ease of explanation, however, the inventive clip (10) will be described with reference to a cap (H) as illustrated in FIGS. 2 and 7, wherein the cap comprises a crown (22), a bill (23), and an inner hat band (20). It will be recognized by those of ordinary skill in the art, however, that the clip (10) may also be secured to a conventional hat having a crown and full circumferential brim (not shown) as well as a visor (V) having an open crown and bill (33), as shown in FIG. 8. For purposes of describing the present invention as claimed herein, the term"crown" shall mean that portion of the hat that covers the wearer's head. The term"crown" shall also refer to the outer head band (32) of a visor (V) that is typically"open," and thus, does not cover the majority of the wearer's head.

To secure the clip (10) to a cap (H), as shown in FIGS. 1–2, and 7, for example, the jaws (11, 12) are opened (FIGS. 1, and 5–6) and then closed together to grasp the inner hat band (20), the inner hat band (20) being sewn to or secured in some fashion at one edge to the lower edge of the hat's crown such that the opposite edge of the hat band is open. When the clip is secured in this way, the jaw (12) carrying the magnet (13) is disposed between the inner hat band (20) and the inner surface (21) of the hat's crown. A ball marker (14) formed of a magnetically attractive material may be secured to the outer surface of the hat's crown (22) by placing it adjacent the position of the magnet (13). "Magnetically attractive material" material, as used herein, may be any material known by those of ordinary skill in the art that will attract to a magnet, such as steel or iron, for example. As discussed above, the magnet must be strong enough to maintain the ball marker on the hat. By securing the clip to the inner hat band (20) as shown, the jaws (11,12) and magnet (13) are hidden from view while the hat is being worn such that only the ball marker (14) is visible. Similarly, the clip (10) may be attached to a visor (V), as discussed above and illustrated in FIG. 8, the visor (V) having an inner head band (not shown) secured at one end to the outer head band portion (32) of the visor (V). While a preferred method of attaching the clip to a cap (or visor) is to secure it to the inner head band, as described above, it will be recognized that if desired, the clip may be secured anywhere on the headgear or other clothing, although the jaws (11, 12) of the clip, for example, would likely be visible.

For better engagement of the clip (10) to the hat, the second jaw (11) may be provided with a pair of sharp teeth (15) capable of piercing the fabric of the inner hat band upon engagement of the clip thereon.

While the embodiments shown in the figures are preferred, it will be recognized in the art that variations of the clip may be employed without departing from the spirit of the invention. For example, the jaw (12) disposed between the inner hat band and the inner surface of the hat's crown, for example, may be magnetized as opposed to carrying a separate magnet (not shown). Alternatively, the clip may be formed of a magnetically attractive material and the ball marker itself formed of a magnetized material or designed to carry a separate magnet (not shown).

What is claimed is:

1. A method of securing a golf ball marker to a hat, said hat comprising a crown having inner and outer surfaces and an inner hat band secured to the crown adjacent the inner surface of the crown, said method comprising:

a. securing a clip to said inner hat band of said hat, said clip comprising (i) first and second jaws hingably secured to one another at one end of each of said jaws; and (ii) a magnet secured to an outer face of said first jaw, wherein when said clip is secured to said hat band, said hat band is disposed between said first and second jaws such that said outer surface of said first jaw, including said magnet secured thereto, is disposed between said hat band and said inner surface of said crown such that said clip is hidden from view when said hat is worn by a person; and b. securing a ball marker to said outer surface of said crown adjacent said magnet, said ball marker formed of a magnetically attractive material such that said marker is magnetically held in place thereon.

2. A method of securing a golf ball marker to a hat, said hat comprising a crown having inner and outer surfaces and an inner hat band secured to the crown adjacent the inner surface of the crown, said method comprising:

a. securing a clip to said inner hat band of said hat, said clip comprising first and second jaws hingably secured to one another at one end of each of said jaws, wherein said first jaw is formed of a magnetic material, and whereby when said clip is secured to said hat band, said hat band is disposed between said first and second jaws such that said outer surface of said first jaw is disposed between said hat band and said inner surface of said crown such that said clip is hidden from view when said hat is worn by a person; and b. securing a ball marker to said outer surface of said crown adjacent said clip, said marker formed of a magnetically attractive material such that said marker is magnetically held in place thereon by said first jaw of said clip.

3. A method of securing a golf ball marker to a hat, said hat comprising a crown having inner and outer surfaces and an inner hat band secured to the crown adjacent the inner surface of the crown, said method comprising:

a. securing a clip to said inner hat band of said hat, said clip comprising (i) first and second jaws hingably secured to one another at one end of each of said jaws, said first jaw formed of a magnetically attractive substance; and wherein when said clip is secured to said hat band, said hat band is disposed between said first and second jaws such that said outer surface of said first jaw is disposed between said hat band and said inner surface of said crown such that said clip is hidden from view when said hat is worn by a person; and b. securing a magnetic ball marker to said outer surface of said crown adjacent said first jaw such that said marker is magnetically held in place thereon.

4. The method of claim 1, wherein said magnetic is a neodymium magnet.

5. The method of claim 2 wherein said first jaw is formed of a neodymium magnet material.

6. The method of claim 3 wherein said golf ball marker is formed of neodymium magnet.

7. A hat clip comprising:

a. first and second jaws hingably secured to one another at one end of each of said jaws, wherein one of said jaws is formed of a magnetically attractive material; and b. a golf ball marker designed for magnetic attachment to said jaw formed of a magnetically attractive material when said jaws are secured to a hat, wherein said golf ball marker is attached to a separate magnet.

8. The hat clip of claim 7, wherein said magnet is a neodymium magnet.

* * * * *